United States Patent [19]

Paris

[11] Patent Number: 4,646,505

[45] Date of Patent: Mar. 3, 1987

[54] STRUCTURAL ELEMENT

[75] Inventor: Luigi Paris, Rome, Italy

[73] Assignee: Sadelmi Cogepi S.p.A., Milan, Italy

[21] Appl. No.: 574,139

[22] Filed: Jan. 26, 1984

[30] Foreign Application Priority Data

Jul. 19, 1983 [IT] Italy ..... 22128 A/83

[51] Int. Cl.[4] ..... E04C 3/30

[52] U.S. Cl. ..... 52/731; 52/648

[58] Field of Search ..... 52/364, 368, 373, 376, 52/632, 696, 722–740, 84, 695, 455, 648; 244/117 R, 123

[56] References Cited

U.S. PATENT DOCUMENTS

| | | | |
|---|---|---|---|
| 385,624 | 7/1888 | Hodges | 52/376 |
| 426,561 | 4/1890 | Dithridge | 52/696 |
| 1,852,622 | 4/1932 | Milburn | 244/123 |
| 1,881,296 | 10/1932 | Potez | 244/123 |
| 2,098,752 | 11/1937 | Miller | 244/123 |
| 2,125,692 | 8/1938 | Ragsdale | 52/731 |
| 2,182,015 | 12/1939 | Davis, Jr. | 52/376 |
| 2,187,280 | 1/1940 | Olson | 52/376 |
| 2,479,819 | 8/1949 | De Ragon | 52/204 |
| 2,774,386 | 12/1956 | Formenti | 52/730 |
| 3,056,266 | 10/1962 | Van Wyk | 52/731 |
| 3,394,507 | 7/1968 | Doke | 52/730 |
| 4,070,845 | 1/1978 | Cody | 52/729 |
| 4,086,978 | 5/1978 | Clements | 182/82 |
| 4,122,647 | 10/1978 | Kovar | 52/695 |
| 4,156,999 | 6/1979 | Avery | 52/376 |

FOREIGN PATENT DOCUMENTS

| | | | |
|---|---|---|---|
| 1002955 | 3/1952 | France | 52/368 |
| 164816 | 6/1921 | United Kingdom | 244/123 |

*Primary Examiner*—John E. Murtagh
*Assistant Examiner*—Andrew Joseph Rudy
*Attorney, Agent, or Firm*—Young & Thompson

[57] ABSTRACT

A structural element for metal structural work is formed, in the manner of a tube, by a pair of half-shell fellow sections, arranged with their concavities opposed and connected together in a discrete manner along their long sides, such as to guarantee a much higher torsional rigidity than that provided by corresponding open sections.

The structures which can be obtained with structural elements of this type include flat and three-dimensional girders, particularly in the form of supports for electric lines, of which the stringers are formed with said elements in order to provide high torsional rigidity.

10 Claims, 12 Drawing Figures

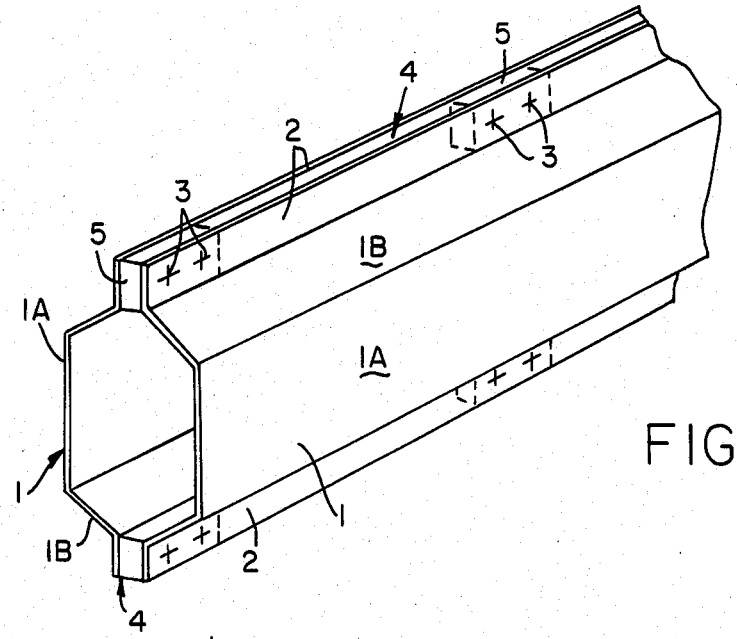
FIG. 1
FIG. 1a
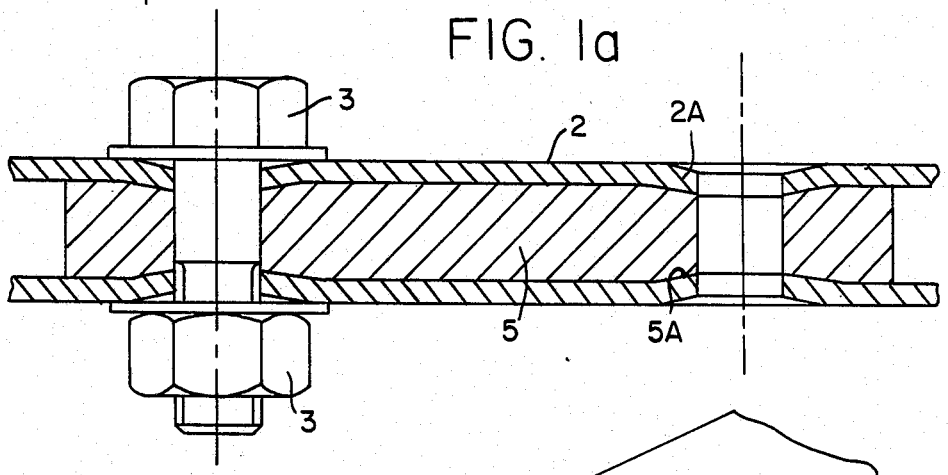
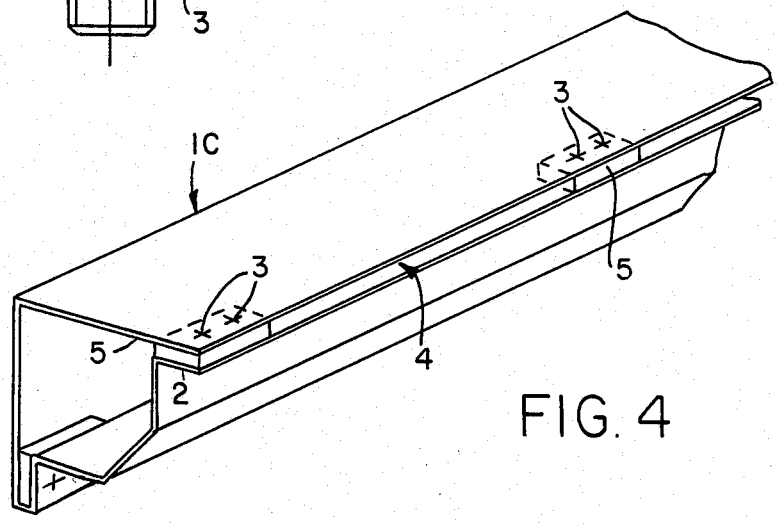
FIG. 4

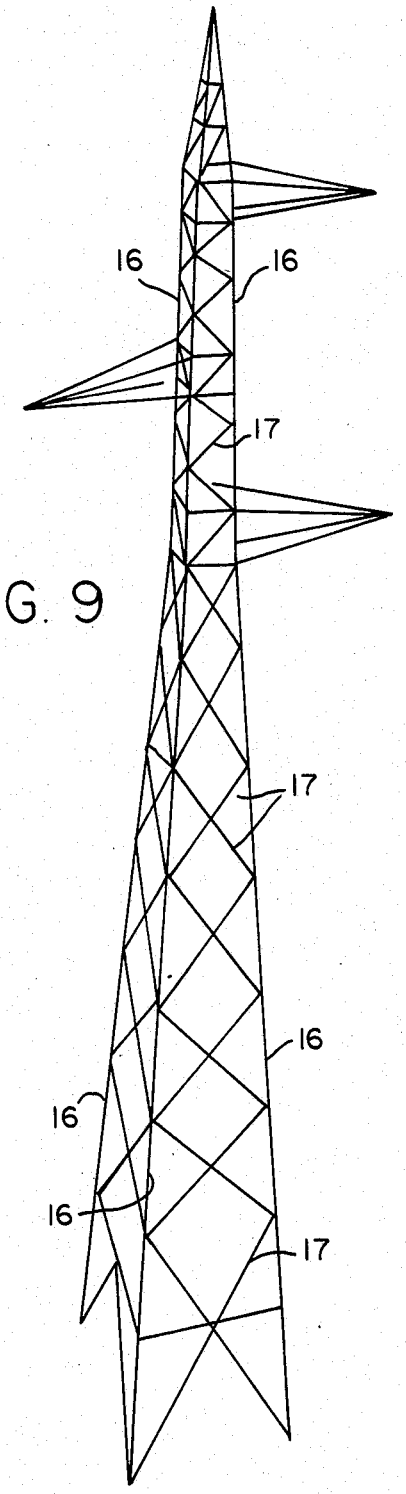
FIG. 9
FIG. 10
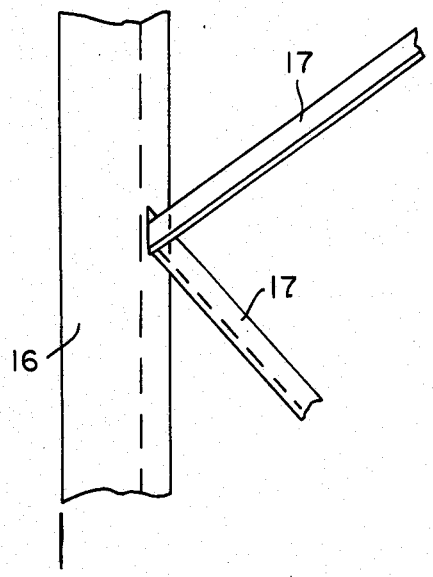
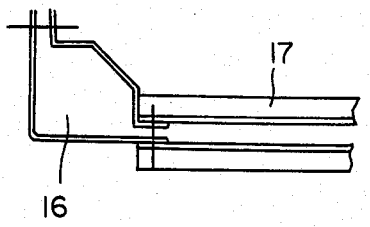
FIG. 11

STRUCTURAL ELEMENT

BACKGROUND OF THE INVENTION

This invention relates to improved structural elements for metal structural work, which have the advantages both of tubular elements (mainly, shape stability and torsional rigidity) and of open sections (mainly, low production costs, easiness of connection, convenience in transportation).

The present invention also relates to structures, generally flat and three-dimensional girders, and in particular supports for overhead electric power transmission lines, which can be constructed in a particularly advantageous manner with said improved structural elements.

For the construction of supports for overhead electric power transmission lines, structural elements are currently used consisting essentially of open sections (usually angle irons), which are favored for their low production costs, easiness of connection, easy protection treatments (galvanising) and reduced transportation bulk.

However these elements, which are well known and widely spread, give rise to local or torsional instability problems when used as bars subjected to combined compressive and bending stresses, such problems being solved by using sections which are thicker and heavier than desirable.

Moreover, flat or slender structures constructed with these conventional elements have very low critical out-of-plane twisting loads, a consequence of the torsional instability of the component parts, and this can be a serious limitation in the planning of certain advanced types of supports for electric lines.

All these drawbacks could easily be eliminated by replacing the structural elements in the form of open sections by tubular metal elements. However these latter, though having properties which have long been known and appreciated, have had litte application in practice because of the high production costs of the tubes, the difficulty of making the connections and the consequent high costs of these latter, and the considerable transportation bulk thereof.

SUMMARY OF THE INVENTION

The object of the present invention is to provide a structural element for metal structural work, which combines the advantageous properties of the aforesaid known structural elements without possessing their defects, thus allowing to plan and construct supports for overhead electric power transmission lines, or any other type of truss or structure, with considerable advantages over the known art.

Essentially, the structural element for metal structural work according to the invention is characterized in that it is formed of a pair of half-shell fellow sections, arranged with their concavities opposed and connected together in a discrete manner along their long sides, such as to guarantee a much higher torsional rigidity than that provided by corresponding open sections.

In this structural element the connection between said half-shell sections is obtained by means of bolts applied at a certain mutual distance between flanges of said sections, said flanges being preferably kept spaced-apart and parallel by inserting cross stiffening brackets in correspondence of the connection bolts, or by interposing sections or bent plates.

The structures which can be constructed using structural elements of the aforesaid type specifically include, in the present invention, a particularly slender flat girder, obtained by forming its stringers with structural elements of the aforespecified type, connected together in such a manner as to prevent any relative rotation of the sections of the two stringers, so that the torsional rigidity of said stringers opposes any lateral deviations (outside the girder plane) of the compressed stringer.

Many other structures for metal structural work can also be obtained, and in particular three-dimensional girders in the form of lattice supports.

BRIEF DESCRIPTION OF THE DRAWINGS

The invention is described hereinafter in greater detail with reference to the accompanying drawings, in which:

FIG. 1 is a fragmentary perspective view of a first embodiment of the structural element according to the invention;

FIG. 1*bis* shows, on an enlarged scale, a construction detail of said structural element;

FIGS. 2, 3 and 4 are fragmentary perspective views of three other embodiments of the structural element according to the invention;

FIG. 9 shows a lattice support or anchor tower for overhead electric power transmission lines, constructed in the form of a three-dimensional girder, using structural elements of the type shown in FIG. 4 according to the invention to form its stringers; and FIGS. 10 and 11 are detailed views of some construction details of the support of FIG. 9.

DESCRIPTION OF THE PREFERRED EMBODIMENTS

Figure 2:
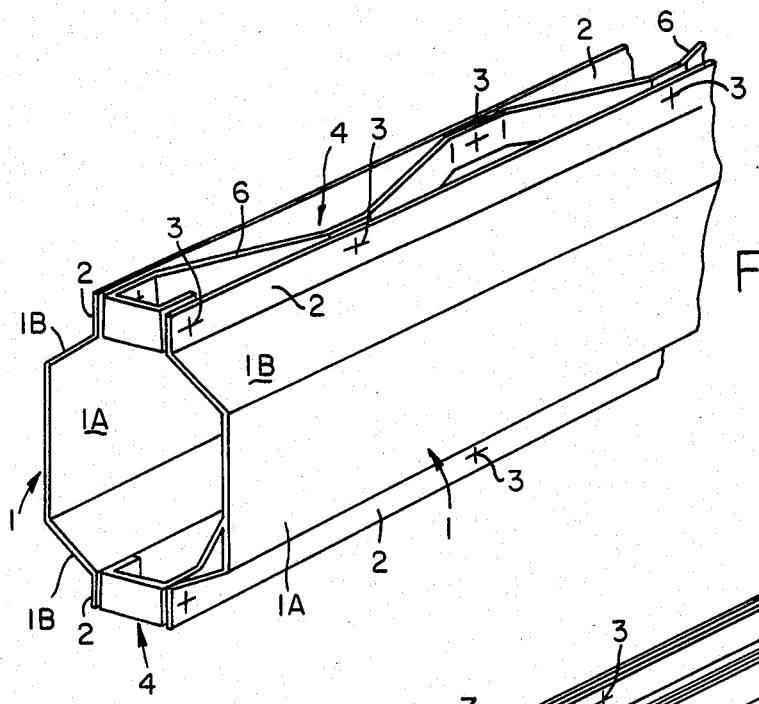
Figure 3:
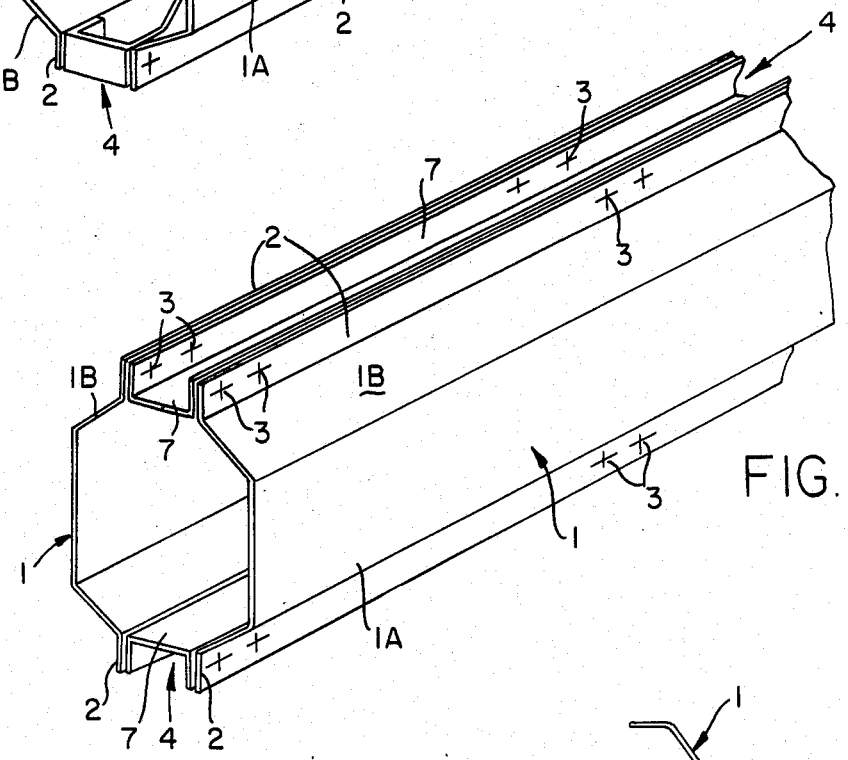

With reference to the drawings, it can be seen from FIGS. 1 to 3 that the structural element according to the invention is formed of a pair of open half-shell fellow sections 1, arranged with their concavities opposed and connected together in a discrete manner along their long sides.

In the embodiments shown, the sections 1 are channel sections with a very wide base 1A and with outwardly inclined sides 1B, terminating in flanges 2 parallel to the base 1A.

The discrete or discontinuous connection of the two sections 1 is obtained, in the illustrated embodiments, by means of bolts 3 applied at a certain mutual distance, either singly or in pairs, between the flanges 2 of said sections 1.

It is preferable to keep the sections 1 and their flanges 2 spaced apart in order to form slots 4 in the structural elements according to the invention, adapted to prevent extended contact between the flanges which could give rise to corrosion phenomena. These slots are also useful for inserting hooking members to facilitate climbing the structures formed therewith, and for introducing means to spray-paint the interior of said structural elements.

For this purpose, cross stiffening brackets 5, disposed at a certain distance apart, are inserted between the flanges 2 in the zones of application of the bolts 3.

One method for connecting together the flanges 2 of the two half-shell sections 1 of the structural element according to the invention, and which is particularly advantageous for attaining the proposed objects, is shown in FIG. 1*bis*. As can be seen, the bores 2A for the bolts 3, in the section flanges 2, are deep-drawn in order to cooperate with corresponding cavities 5A provided in the surfaces of the cross stiffening brackets 5.

This arrangement prevents any possible relative sliding between the thus connected flanges 2 of the two sections forming the structural element, thereby also increasing the torsional rigidity of the structural element itself.

Further solutions are shown in FIGS. 2 and 3, wherein a zigzag bent plate 6 and a channel section 7 are respectively interposed between the flanges 2 of the half-shell sections 1.

A solution representing a combination of those illustrated is also possible. This is obtained by connecting the flanges 2 to the plate 6 or section 7—rather than in a discrete manner—with the interposition of cross stiffening brackets 5.

FIG. 4 shows a structural element according to the invention, particularly suited to form the stringers of three-dimensional girders, for example for lattice supports for overhead electric power transmission lines. This element is formed by associating a half-shell section 1, of the type used for the structural elements of FIGS. 1 with 3, to a simple angle section 1C. The connection is again obtained using cross stiffening brackets 5 and bolts 3, applied between the flanges 2 of the section 1 and the edges of the long sides of the section 1C acting as flanges. Also in this case, slots 4 are formed between the two sections of the structural element, for the assembly of which the construction method of FIG. 1*bis* can be used with all the advantages deriving therefrom.

In each case—as can be seen—a structural element is obtained, formed as a tube but the component parts of which are open sections.

Figure 5:
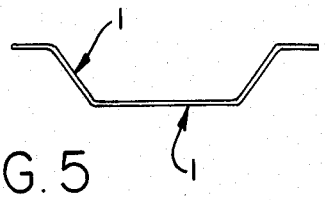
FIG. 5 shows the transport packaging system for the half-shell sections used to form the structural elemenets of FIGS. 1 to 4.

This element has all the advantages of open sections, with regard to productions costs, easiness of connection (as illustrated hereinafter), easy galvanizing, and reduced transportation bulk (as can be easily seen from FIG. 5, which shows the system for packaging the component half-shell sections). It also has the essential advantage of structural tube elements, namely to guarantee a much higher torsional rigidity than the corresponding open sections. However, the structural element according to the invention has none of the basic drawbacks of tubes. In the element according to the invention, by varying the assembly method of the component half-shell sections, it is also possible to vary the strength and flexural rigidity according to one axis. Thus, with the elements of FIGS. 2 and 3, in which the bent plates 6 or channel sections 7 are inserted between the flanges 2 of the sections 1, a greater spacing is obtained between the component half-shell sections, and thus an increased strength and flexural rigidit than in the element of FIG. 1, in which the component sections 1 are closer together as they are separated by the thinner cross stiffening brackets 5.

The assembly can also be carried out in such a manner as to continuously vary the strength along the length of the structural element, by using cross stiffening brackets of different thickness, or plates or sections of variable thickness, for spacing the flanges of the opposed half-shell sections. A tapered structural element can thus be formed.

It should also be noted that the component sections of the element according to the invention can be manufactured using the same rolls for different sizes of their base 1A, leading to a further advantage in production costs.

With the structural elements according to the invention, it is possible to very advantageously obtain a particularly slender flat girder, with the two stringers formed from said elements, connected together in such a manner that the torsional rigidity of the stringers prevents any lateral deviations—outside the girder plane—of the compressed stringer.

Figure 6:
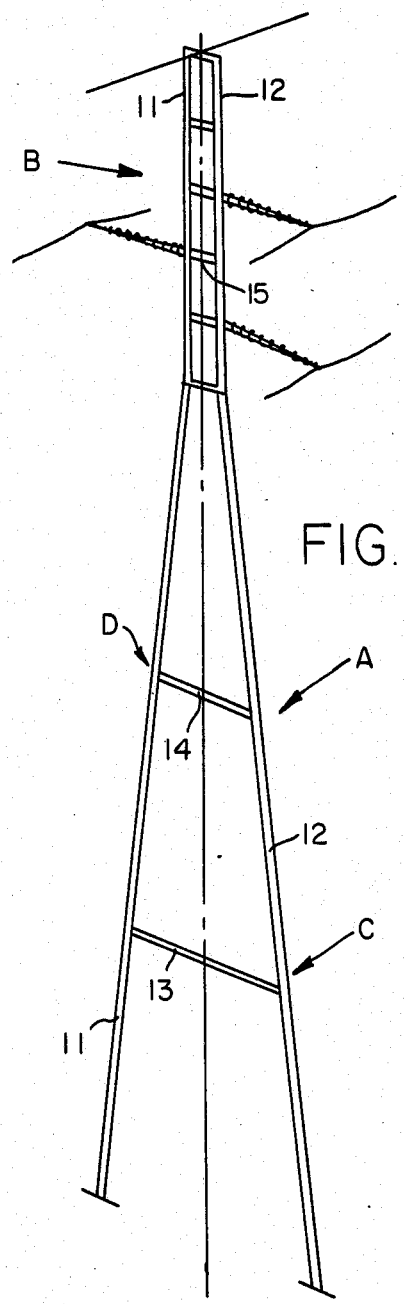
FIG. 6 is a diagrammatic illustration of the bidimensional self-braced trestle support for overhead electric power transmission lines, constructed as a particularly slender flat girder, using structural elements of the type shown in FIGS. 1 to 3 according to the invention to form its stringers.
Figure 8:
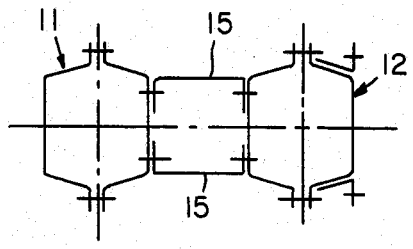
FIGS. 7 and 8 are detailed views of some construction details of the support of FIG. 6.
Figure 7:
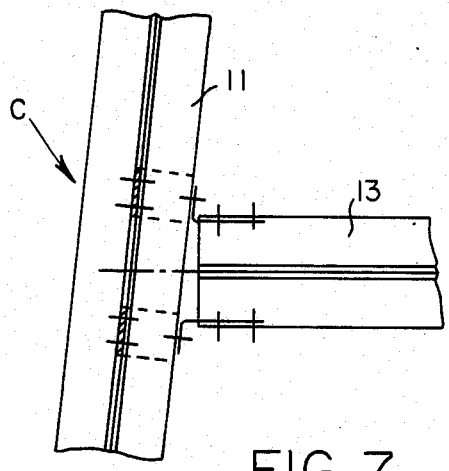

An example of a girder of this type is the bidimensional self-braced trestle support for overhead electric power transmission lines shown in FIG. 6. To construct this support, two sets of structural elements 11 and 12 according to the invention are used, for example of the type shown in FIG. 1, arranged to form two stringers which are mutually inclined over the major length A of the height of the support, but which run parallel and close to each other at the top B of said support. The stringers formed by the elements 11 and 12 are connected together in two zones C and D by similar transverse elements 13 and 14. FIGS. 7 and 8 show respectively a possible scheme for connecting together the elements 11 and 13 in zone C of the support, and for connecting together the elements 11 and 12 in the top part B of said support (this latter connection being obtained by applying simple channel sections 15). The simplicity, easiness and efficiency of the connections between the support components can be easily deduced from these figures.

It should be noted that the support of FIG. 6 could advantageously be formed in its top part B as a single element shaped as a tube, by joining together the two structural elements which form its stringers through connection of their two outer half-shell sections with two inner channel sections (namely forming a the top B of the support a single structural element of the type shown in FIG. 3).

The structural elements according to the invention are suitable not only for constructing any appropriate type of metal structural work—with all the advantages deriving from combining the merits of open sections and of tubes, but without their defects—but also for forming ordinary three-dimensional girders, in particular three-dimensional supports for overhead electric power transmission lines.

FIG. 9 is a diagrammatic view of one of these supports, in the form of a girder comprising four stringers 16, each constituted by structural elements according to the invention of the type shown in FIG. 4. FIGS. 10 and 11 are a side view and, respectively, a horizontal section view of one of the stringers 16, at the connection of the lattice members 17.

It is apparent that, using the structural elements of FIG. 4 according to the invention, in a support of the type shown in FIG. 9, drastically reduces problems deriving from torsional and local instability, which are always present in such structures, whereby sections of very reduced thickness, and thus much lighter, can be used in said structures, with obvious considerable advantages.

It is to be understood that only some embodiments of the structural element according to the invention and some examples of the structures which can be constructed therewith, have been described and illustrated. Other embodiments of the structural element, or modifications of those shown, obviously fall within the scope of the present invention, which also comprises any type of structure—even if quite different from those shown by way of example—using said structural element.

I claim:

1. In a structural element formed as a tube for metal structural work having high torsional rigidity and being of easy assembly and disassembly and of easy transport, comprising a pair of elongated half-shell sections, each of which has a concavity and flanges extending along both longitudinal sides of said concavity and has such a shape as to allow them to be stacked, said sections being arranged with their concavities opposed; the improvement in which said flanges are interconnected by means of spaced bolts, and means through which said bolts pass, disposed between said flanges and maintaining said flanges of said half-shell sections spaced apart and parallel, said flanges of said half-shell sections being kept spaced-apart and parallel by cross stiffening brackets through which said bolts pass, the cross stiffening brackets comprising cavities receiving deep-drawn portions of bores for the bolts of the section flanges, in order to prevent mutual sliding between said flanges.

2. A structural element as in claim 1, wherein at least one of the half-shell sections in a channel section with a very wide base and outwardly inclined sides.

3. A structural element as in claim 1, formed with two half-shell sections of the same shape.

4. A structural element as in claim 1, formed with a half-shell channel section having a very wide base and outwardly inclined sides, and with an angle section having edges of its long sides acting as flanges.

5. A structural element as in claim 1, in which there are open spaces between said flanges and between said bolts.

6. A flat girder, having stringers that are constituted by structural elements as claimed in claim 1.

7. A particularly slender flat girder, having stringers that are formed by structural elements as claimed in claim 1, connected together in such a manner as to prevent any relative rotation of sections of said stringers, so that the torsional rigidity of said stringers opposes any lateral deviations thereof.

8. A flat girder as in claim 6, comprising a bidimensional self-braced trestle support for overhead electric power transmission lines.

9. A three-dimensional girder, having stringers that are constituted by structural elements as claimed in claim 1.

10. A three-dimensional girder as in claim 9, comprising a lattice support for overhead electric power transmission lines, constructed in such a manner that the torsional rigidity of said stringers prevents instability thereof under combined compressive and bending stresses.

* * * * *